US005671006A

United States Patent [19]

Billiot

[11] Patent Number: 5,671,006

[45] Date of Patent: Sep. 23, 1997

[54] METHOD OF USING COLOR LASER-PRINTED GRAPHICS WITH MULTIPLE WEIGHT SHEET STOCKS

[76] Inventor: Edwine Anthony Billiot, P.O. Box 2051, Morgan City, La. 70831

[21] Appl. No.: 491,067

[22] Filed: Jun. 16, 1995

[51] Int. Cl.[6] ..... B41J 2/435

[52] U.S. Cl. ..... 347/262; 283/75

[58] Field of Search ..... 347/232, 262, 347/264, 139; 283/74, 75, 79

[56] References Cited

U.S. PATENT DOCUMENTS

| | | |
|---|---|---|
| 3,994,225 | 11/1976 | Sitzberger . |
| 4,687,526 | 8/1987 | Wilfert . |
| 4,773,953 | 9/1988 | Hare . |
| 4,804,827 | 2/1989 | Jung . |
| 4,966,352 | 10/1990 | Nuttin . |
| 4,999,065 | 3/1991 | Wilfert . |
| 5,096,229 | 3/1992 | Carlson . |
| 5,131,686 | 7/1992 | Carlson . |

*Primary Examiner*—Mark J. Reinhart
*Attorney, Agent, or Firm*—Richard C. Litman

[57] ABSTRACT

A method of using color laser printing technology to create printed matter on heavy sheet stock incapable of being accepted by a color laser printer by instead using a plurality of sheets and laminating them after printing so as to be equivalent in total weight to the weight of the non-acceptable weight sheet stock. Laminating sheet stock enables applications requiring use of heavy weight sheet stock to take advantage of laser printer and computer graphics technology. Graphics are created by use of desk-top publishing software, and then are printed using a high-quality color laser printer onto sheet stock regularly capable of being accepted by color laser printers. Supplies of backing sheet stock are obtained and combined with the laser printed sheet stock so as to obtain an end-product weight comparable to that of a sheet stock weight ordinarily used for the given application. The laser printed sheet stock is then fed through a commercially available table-top adhesive applicator and a adhesive is thinly and evenly applied to the back of each printed sheet. The adhesive printed sheet is then applied against the backing stock, pressure is applied to the laminated sheet to form an even surface, and the adhesive allowed to dry. The laminated sheet is then cut and trimmed according to the appropriate orientation of its printed indicia.

9 Claims, 2 Drawing Sheets

METHOD OF USING COLOR LASER-PRINTED GRAPHICS WITH MULTIPLE WEIGHT SHEET STOCKS

BACKGROUND OF THE INVENTION

1. Field of the Invention

The present invention relates to a method of using color laser printing technology to create printed matter on heavy sheet stock incapable of being accepted by a color laser printer by instead using a plurality of sheets and laminating them after printing so as to be equivalent in total weight to the weight of the non-acceptable sheet stock.

2. Description of the Prior Art

With the advance of printing technology, color printing methods available to the desktop publisher and small commercial printer are allowing near-photographic reproduction and generation of customized graphics at rising printing speeds and relatively low cost. Generally, desktop color printers include five groups of printers: color laser printers, color liquid inkjet printers, color solid inkjet printers, thermal transfer printers and dye-sublimation printers. Each have certain advantages and disadvantages. Nevertheless, the general contention in the printer industry is that color laser printers hold an edge over the remaining groups for mid-volume, general purpose color printing applications.

Nevertheless, important disadvantages still exist in the color laser printer that fail to justify its use for certain applications. For example, no color laser printers are currently available for reliable and consistent production of printed materials on paper sheet stock of heavier weight than writing paper sheet stock. This critical limitation prevents the use of a color laser printer for applications which require stiff paper sheet stock, such as business cards, invitations and counter stand-up displays.

Paper is commonly described and sold in pound weights. For example, twenty pound (20#) and twenty-four pound (24#) bond is commonly used for typing paper and letterhead, respectively (hereinafter collectively "writing paper sheet stock"). Ninety pound (90#) index sheet stock is commonly used for 3"×5" index cards. Eighty pound (80#) cover sheet stock is commonly used for business cards. Heavier-weight sheet stock, such as 65# to 130# cover sheet stock, may be used for various advertising applications such as stand-up counter displays.

Presently, although color laser printers have been reported to be able to handle paper weights of up to 48 pounds, they are only practically capable of handling larger volumes of paper of only 24 pound weight. Although ink-jet printers are currently available that are able to be fed individual sheets of 80# stock, the disadvantages associated with using an ink-jet printer make its use undesirable for many small-business or consumer-oriented applications of the heavier-weight sheet stock. For example, liquid inkjet printers are slow with output speeds of no better than one page per two minutes. Because these printers use water-soluble ink, they can exhibit problems such as low color saturation, fuzzy edges on images and text, smeared colors and wrinkles in heavily inked areas. These disadvantages become magnified when printing applications such as business cards and invitations require that common printed indicia be repeatedly printed several hundred times. Irregular printed products and slow output times can result in the printer suffering increased production costs and customer dissatisfaction.

In comparison, color laser printing places a "print-permanent" finish (no peeling, fading or cracking) by use of an electrostatically placed toner onto the sheet stock at outputs of two pages per minute. These qualities are ideal for volumes of work which require consistent and quick printing output, but do not justify the costs of high-end printing equipment. Whereas dye-sublimation printers are capable of creating a high-quality image which is also print-permanent, the costs of these printers exceed the cost of color laser printers by two- to three-fold in the tens of thousands of dollar range and have a print output of three to ten minutes per page. Moreover, the printing costs of dye-sublimation cost is high, requiring special printing papers, resulting in nearly ten times per sheet the cost of color laser printing. For retail consumer-oriented applications such as business cards, the use of dye-sublimation printing would result in uncompetitive prices.

Therefore, a need exists for a method of providing a printed product on heavier-weight sheet stock which can take advantage of color laser printer technology. Methods for producing various printed matter using computer controlled printing is found in the prior art, but none of the methods use desk-top publishing and color laser printing to create printed matter on heavy sheet stock incapable of being accepted by a color laser printer.

For example, U.S. Pat. No. 3,994,225 issued Nov. 30, 1976 to Sitzberger describes a method of producing personalized identification badges, 8 to 10 to a sheet, wherein indicia common to all badges is printed in an initial step by printing on badge stock. A separate step of electrostatic printing or copying of variable printed indicia from a master sheet onto a transfer film is utilized to imprint the badge with personalizing material. After transfer, the multiple identification badges on the sheet stock are separated from each other to be encased in a holder.

U.S. Pat. No. 4,773,953 issued Sep. 27, 1988 to Hare describes a method of making tee-shirts using computer generated images. The design is first created by hand on a monitor screen of the computer system, then printed onto a heat transfer sheet. The design is then ironed onto the fabric.

U.S. Pat. No. 4,804,827 issued Feb. 14, 1989 to Jung describes a durable waterproof identification card consisting of a two-layer paper laminate which results in superior electrostatically printing qualities. The paper layers are calendared and coated with a sizing material to obtain a relatively poreless surface. The card is laminated by using a colored adhesive between layers and then covered by a varnish except where printing is to occur. Printing of the card can take place after lamination in areas which are not varnished.

The patents to Wilfert, U.S. Pat. No. 4,687,526 issued Aug. 18, 1987 and U.S. Pat. No. 4,999,065 issued Mar. 12, 1991, describe a method of making high-security identification cards which use computer generated alpha-numeric characters in combination with camera generated images. The images and alpha-numeric characters are combined electronically, which information is then fed to a laser printer to print the data onto a paper sheet. The paper is then laminated between transparent plastic sheets so as to fuse the plastic into the paper fibers.

Each of the patents to Carlson, U.S. Pat. No. 5,096,229 issued Mar. 17, 1992 and U.S. Pat. No. 5,131,686 issued Jul. 21, 1992, describes a method of forming laser printed identification cards from multiple thickness sheet stock for the purpose of preparing mass-produced mailers. A die-cut plastic sheet stock is adhered to a core sheet of paper. To prevent the plastic sheets from improperly feeding and printing, the inventor's solution places and adheres a second sheet of paper over most or all of the paper which is not covered by the plastic.

U.S. Pat. No. 4,966,352 issued Oct. 30, 1990 to Nuttin describes a complex mechanical system for processing a continuous web linked to a computer which controls the creation of business documents and envelopes. In a late stage in the process, multiple webs are glued along the edges by using rollers to form multi-layered sheets separable at time of use.

Neither the Wilfert, nor the Carlson, patents address the difficulty of using multi-color laser printing with heavier-weight sheet stock for ordinary multi-color laser printed applications such as business cards and invitations. None of the above inventions and patents, taken either singly or in combination, is seen to describe the instant invention as claimed.

SUMMARY OF THE INVENTION

The present invention relates to a method of using color laser printing technology to create printed matter on heavy sheet stock incapable of being accepted by a color laser printer by instead using a plurality of sheets and laminating them after printing so as to be equivalent in total weight to the weight of the non-acceptable sheet stock. By laminating two sheets of paper stock together so as to simulate the properties of heavier-weight sheet stock, printed applications requiring such heavier-weight sheet stock are able to take advantage of color laser printer and computer graphics technology. The method allows creation of high-quality color business cards, invitations and stand-up counter displays by using computer generated graphics and low-cost color laser printing currently affordable and available to the consumer.

The preferred embodiment of the present invention is a method in which the first step involves use of high-quality computer graphics software. Invitations or business cards are created on a computer capable of handling memory demands of such software. Then, using a high-quality color laser printer, the graphics are then printed on sheet stock of weight of 24# or less and of a size commonly accepted by color laser printers, usually standard letter-size or legal-size sheets. If the products to be manufactured are business cards, arrays of 10 cards per sheet may be printed in color on a single letter-size sheet.

In the next stage of the present method, various supplies of backing sheet stock are obtained and combined with the printed sheet stock. A predetermined weight-backing sheet stock can be combined with the 20# or 24# color laser printed sheet stock to obtain a end-product weight comparable to that of the weight of the sheet stock ordinarily used for the given application. The laser printed sheet stock is then fed through a commercially available table-top adhesive applicator. The adhesive applicator aligns the edges of the sheet stock and applies a permanent adhesive thinly and evenly on the back of each printed sheet. The adhesive printed sheet is then applied against the backing stock without formation of bubbles or wrinkles. Sufficient pressure can then be applied to the combined printed sheet stock and backing stock to form a laminated sheet. The adhesive is allowed to dry, whereupon the layers of the sheets become nearly undetectable to the naked eye. The laminated sheet is then cut and trimmed according to the appropriate orientation of its printed indicia.

Accordingly, it is a principal object of the invention to provide a method of using color laser printing technology for the creation of printed matter on laminated sheets equivalent in weight to sheet stock which is incapable of being handled for printing by a color laser printer.

It is another object of the invention to provide a method by which color laser printed business cards, invitations and other common color printing applications for heavier-weight sheet stock can be created.

It is a further object of the invention to provide a method which simulates the pound weight of heavier-weight sheet stock by laminating plurality of lighter weight sheet stock by use of an adhesive to achieve nearly undetectable layers.

Still another object of the invention is to provide a method which produces a reliable, high-quality repeated and common imprint of indicia by color laser printer for applications requiring heavier-weight sheet stock.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention relates to a method of using color laser printing technology to create printed matter on heavy sheet stock incapable of being accepted by a color laser printer by instead using a plurality of sheets and laminating them after printing so as to be equivalent in total weight to the weight of the non-acceptable sheet stock.

Figure 1:
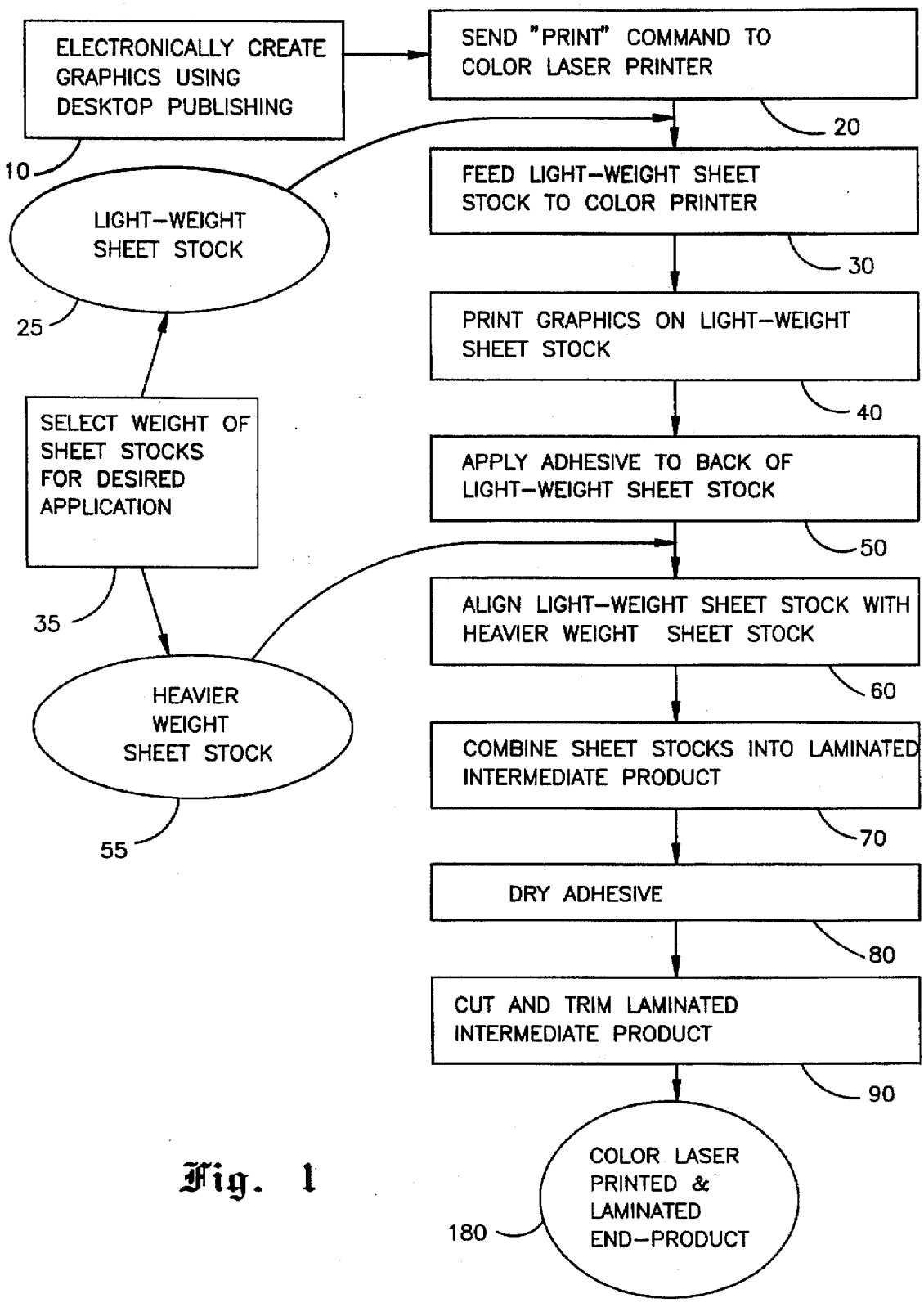
FIG. 1 is a block diagram representing the method of using color laser printed graphics with multiple weight sheet stocks.
Figure 2:
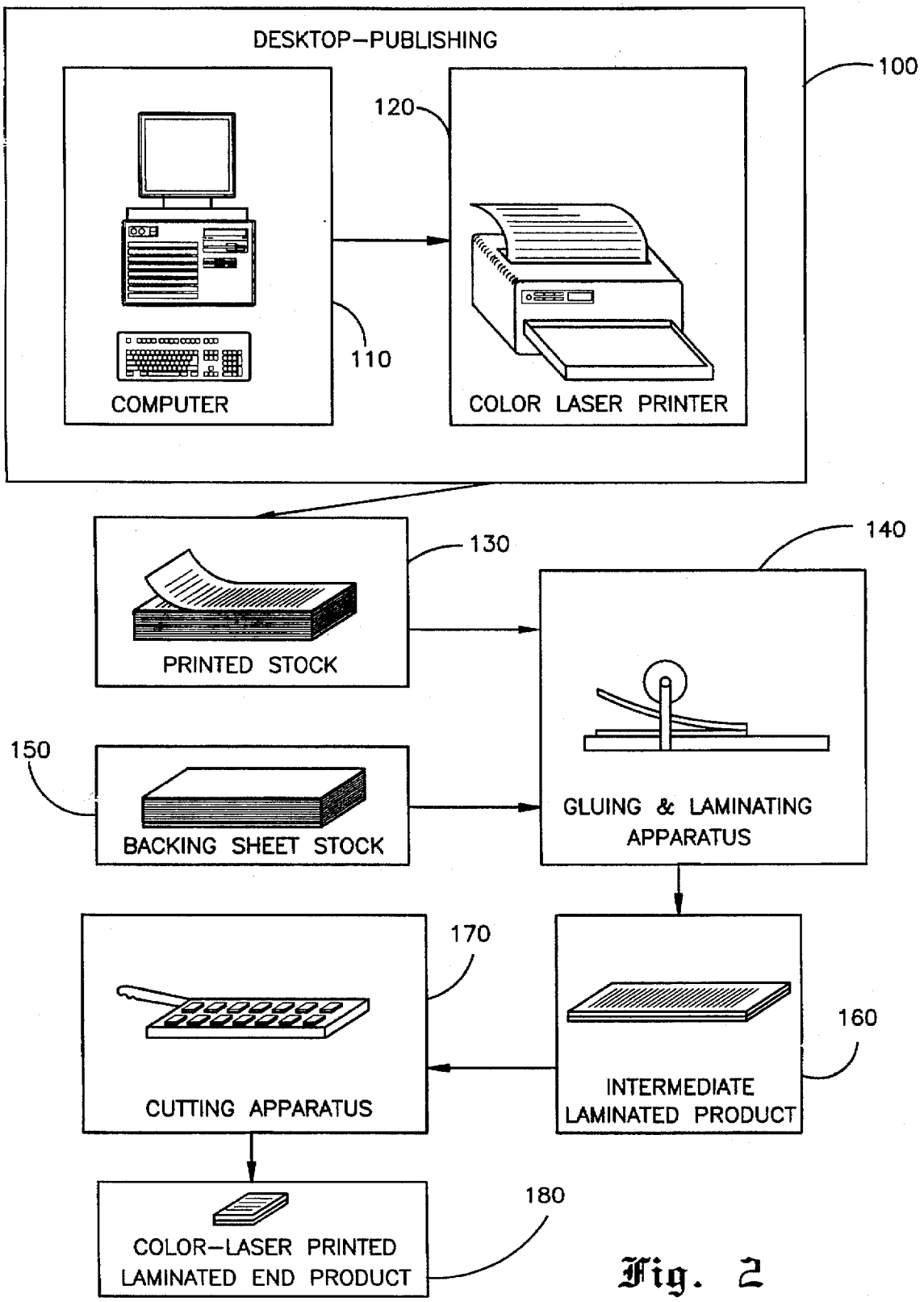
FIG. 2 is a block diagram representing the apparatus used in the method of using color laser printed graphics with multiple weight sheet stocks.

Referring to FIG. 1, an overview of the preferred embodiment of the present invention is shown comprising of a series of steps represented by blocks 10 through 90 in an application for printed business cards. The circles represent various weights of sheet stock 25,55 used in the method of creating a color laser printed end-product, represented at circle 180, in this instance business cards. Referring to FIG. 2, an overview of the various devices which may be used throughout the method are shown in blocks 100 through 170.

Referring to both FIG. 1 and FIG. 2, the first step 10 is to design the graphics which are to printed on the sheet stock in the creation of business cards. The purpose of the method is to take advantage of the high-quality desktop publishing apparatus 100 and computer graphics software programs readily available to the consumer and well known in the prior art which allow creation of sophisticated designs, backgrounds, fonts, type-faces and scripting styles. A computer 110 capable of handling the memory demands of such software is necessary. Upon creation and manipulation of the graphics so as to achieve a predetermined printing orientation, a command can be sent to print the graphics 20.

Because present color laser printer limitations require use of no greater than 48# sheet stock, the user must obtain a supply of sheet stock which the color laser printer 120 is capable of accepting. Such light-weight sheet stock is represented in circle 25, usually 20# or 24# paper sheet stock of a standard paper size compatible for feeding into a color laser printer feed slot through the use of a feed tray. A high-quality color laser printer is represented at 120 loaded with light-weight sheet stock in the feed tray. In the case of most laser printers, the feed step 30 is automatic.

The graphics are then printed automatically 40 on the light-weight sheet stock 25, yielding a printed stock 130. In the case of business card applications, the orientation of the graphics can be arrayed so that 10 cards per sheet may be color printed on a single letter-size sheet. However, upon completion of the printing step, the weight of the paper makes this printed stock undesirable in an ordinary business card application without further modification.

Therefore, in the next stage of the inventive method, the user must obtain various supplies of backing sheet stock 150 of a predetermined weight. The user selects the weight of the backing or heavier weight sheet stock 55 by determining a relationship between the weight of sheet stock selected for light-weight sheet stock and the weight sheet stock of an end-product ordinarily used for the given application. For example, obtaining an end-product comparable in weight to standard 80# weight sheet stock commonly used for business cards, 24# sheet stock can be combined with 90# weight index sheet stock. Depending upon the weight of the end-product desired to be simulated and the weight of the light-weight sheet stock used, the combinations of individual weight sheet stock used to achieve a desired effect will vary.

Nevertheless, although the weights of the end-product may vary depending upon the desired application, the variable representing the light-weight sheet stock is limited by the maximum weight of the sheet stock which can be fed into the laser printer. However, a relationship for a given application may be expressed in the following formula: FP#–PSS#=BSS#; where (1) FP# is the weight of the sheet stock used for a predetermined application and which sheet stock is not capable of being accepted by a color laser printer, (2) PSS# is the weight of the sheet stock used in the printing step and fed into the color laser printer, limited by the specifications of the color laser printer, and (3) BSS# is the resulting weight of the sheet stock.

Thus, the user can feed the laser printed stock 130 through a commercially available table-top adhesive applicator 140 in order to affix and align the heavier-weight sheet stock to the printed light-weight sheet stock 25,130. The adhesive applicator 140 will apply a permanent adhesive thinly and evenly on the back of each printed sheet 50. The resultant adhesive-affixed printed stock is then aligned with the heavier-weight backing sheet stock 55,150 and combined in step 70 by applying the adhesive-affixed printed stock against the backing stock, with elimination of formation of bubbles or wrinkles, with sufficient pressure so as to form a laminated intermediate product 160. The adhesive is allowed to dry 80. Using an appropriate cutting apparatus 170, the laminated intermediate product 160 is then cut and trimmed 90 in accordance with the appropriate orientation of its printed indicia. In the case of business cards arrayed in two columns of five, the array is cut into 10 individual rectangular business cards, as represented by the color laser printed and laminated end-product 180.

It is to be understood that the present invention is not limited to the embodiment described above, but encompasses any and all embodiments within the scope of the following claims.

I claim:

1. A method of use of color graphics printing comprising the steps of:

providing desktop publishing apparatus comprising at least a computer and a multi-color laser printer;

providing a supply of light-weight sheet stock comprising sheet stock dimensioned to be accepted by said multi-color laser printer for printing thereon and which sheet stock is limited to no greater than 60 pound weight;

designing graphics using said desktop publishing apparatus whereby backgrounds, fonts, type-faces, scripting styles and other designs may be created;

sending a command to said multi-color laser printer to print said graphics on said light-weight sheet stock;

feeding said light-weight sheet stock to laser printer for printing thereon, whereby a color laser printed stock is yielded;

selecting predetermined, preselected-weight sheet stock;

applying an adhesive to at least one surface of at least one said sheet stocks;

aligning said printed color laser printed stock with said preselected-weight sheet stock in a predetermined orientation;

combining said printed color laser printed stock with said preselected-weight sheet stock to yield a unitary laminated product.

2. The method of color graphics printing according to claim 1, further comprising the step of cutting and trimming said laminated product in accordance with the appropriate orientation of its printed indicia to yield an end-product.

3. The method of color graphics printing according to claim 1, further comprising the step of drying the adhesive.

4. The method of color graphics printing according to claim 1, wherein the step of aligning further comprises the step of orienting a plurality of rectangularly dimensioned graphics exhibiting common printed indicia into an array, thereby enabling the maximum number of said rectangular configurations to non-overlappingly fit into the dimensions of one surface of said light-weight sheet stock, whereby an application for printing of business cards can be achieved.

5. The method of color graphics printing according to claim 1, wherein the step of feeding said light-weight sheet stock is automatically performed by the multi-color laser printer.

6. The method of color graphics printing according to claim 1, wherein the step of printing the graphics is automatically performed by the multi-color laser printer upon sending the print command.

7. The method of color graphics printing according to claim 1, wherein selecting the weight of the preselected-weight sheet stock is determined by the formula $$FP\#-PSS\#=BSS\#$$

where a. FP# is a weight of sheet stock not capable of being accepted by a color laser printer and used for a predetermined application;

b. PSS# is a weight of the sheet stock used in the feeding and printing steps, the maximum weight of PSS# being determined by the specifications of the multi-color laser printer; and c. BSS# is a resulting weight of the sheet stock to be selected, whereby a relationship is established between the weight of sheet stock selected for light-weight sheet stock and the weight sheet stock of an end-product ordinarily used for the given application desired to be simulated.

8. The method of color graphics printing according to claim 1, wherein said steps of applying an adhesive and aligning said printed color laser printed stock are performed in one continuous operation using a table-top adhesive application device.

9. The method of color graphics printing according to claim 1, wherein said step of applying an adhesive is performed by thinly and evenly applying said adhesive to each color laser printed sheet on the surface opposite the surface on which the printed indicia appears.

* * * * *